United States Patent [19]

Scalera

[11] 4,392,588

[45] Jul. 12, 1983

[54] NOZZLE ASSEMBLY FOR COLD DRINK MERCHANDISER

[75] Inventor: Frank T. Scalera, Maplewood, N.J.

[73] Assignee: Rowe International, Inc., Whippany, N.J.

[21] Appl. No.: 227,482

[22] Filed: Jan. 22, 1981

[51] Int. Cl.[3] ..... G07F 13/06

[52] U.S. Cl. ..... 222/129.4; 239/422

[58] Field of Search ..... 222/129.1, 129.2, 129.3, 222/129.4, 173, 186, 566, 330; 239/433, 422, 423, 418, 600, 428; 312/35, 45; 248/75

[56] References Cited

U.S. PATENT DOCUMENTS

| | | | |
|---|---|---|---|
| 1,261,986 | 4/1918 | White | 222/129.1 |
| 2,835,410 | 5/1958 | Arnett et al. | 222/129.1 |
| 3,986,642 | 10/1976 | Selvia et al. | 222/129.1 |
| 4,319,698 | 3/1982 | Tomiyama et al. | 222/129.1 |

*Primary Examiner*—Stanley H. Tollberg

*Attorney, Agent, or Firm*—Shenier & O'Connor

[57] ABSTRACT

A nozzle assembly for use with a cold drink machine for selectively delivering a plurality of drinks each having a beverage principal component and a beverage flavoring component to a cup positioned at a delivery location accessible to a customer in which a unitary body of molded synthetic resin is formed with a base having an upwardly extending centrally located guide provided with a bore for receiving a beverage principal component delivery fitting having a discharge flow axis and with a wall extending upwardly around the guide from said base to a rim and with the inner surface inclined inwardly from the rim to the base. A plurality of grooves spaced around said guide and extending along said inner wall surface into holes in said base are adapted to receive and position respective flavoring nozzles with the flow axes thereof intersecting said fitting flow axis at a predetermined point.

11 Claims, 4 Drawing Figures

NOZZLE ASSEMBLY FOR COLD DRINK MERCHANDISER

FIELD OF THE INVENTION

My invention is in the field of cold drink merchandisers and, more particularly, in the field of nozzle assemblies for cold drink merchandisers.

BACKGROUND OF THE INVENTION

There are known in the prior art, merchandising machines which are adapted to deliver cold drinks in response to the deposit therein of a sum of money. In general, such machines are designed to deliver a variety of beverages of different flavors which may be either still or carbonated water and which may be dispensed with or without ice. In one type of beverage dispensing machine, the flavoring constituent and the water constituent are mixed directly in the cup in which the beverage is delivered to the customer and the ice, if any, is delivered to the cup at some point in the operating cycle of the machine.

In machines of the type described above, a plurality of nozzles leading from the respective syrup supplies and a water outlet member are assembled at a location above the cup delivery station and are so oriented as to deliver the syrup and water into the cup. In addition, an ice delivery chute is supported so as to direct ice from the icemaker storage bin to the cup. To insure an adequate mixing, each nozzle is positioned so that its stream of flavored syrup intersects with the common water stream at a prescribed angle and location relative to the cup.

In most nozzle holders of the prior art, the individual nozzles are formed of metal and soldered into position on a metal bracket. While these nozzle holders assure accurate positioning of the nozzles for intersection of the syrup stream with the water stream, if the initial assembly operation is properly done, later adjustment is not possible. Moreover, the individual nozzles cannot be readily removed for cleaning or replacement. In addition, this arrangement prevents the quick replacement of an individual nozzle with one having a larger internal diameter for use with a heavier syrup.

Selvia et al. U.S. Pat. No. 3,986,642 issued Oct. 19, 1976, discloses an alternate form of nozzle and holder assembly in which blocks clamped together form ball and socket supports with elements on the nozzles adjustably to support the nozzles. The arrangement permits the removal and replacement of the individual nozzles by unclamping the blocks. However, as the nozzles must be repositioned by hand each time they are removed, this arrangement does not automatically ensure accurate positioning of the nozzles for intersection of the syrup stream with the water stream as the nozzles are replaced.

OBJECTS OF THE INVENTION

One object of my invention is to provide a nozzle assembly for a cold drink merchandiser which overcomes the defects of assemblies of the prior art.

Another object of my invention is to provide a nozzle assembly comprising a holder which is formed from easily molded parts and which is relatively inexpensive in construction.

Still another object of my invention is to provide a nozzle assembly for a cold drink merchandiser in which the nozzles may be easily removed and replaced.

A further object of my invention is to provide a nozzle assembly for a cold drink merchandiser in which each nozzle is accurately automatically positioned to direct its stream of syrup at a desired angle relative to a common stream of water as the nozzle is assembled on the holder.

A still further object of my invention is to provide a nozzle holder which supports and properly positions an ice chute.

Other and further objects of my invention will appear from the following description.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
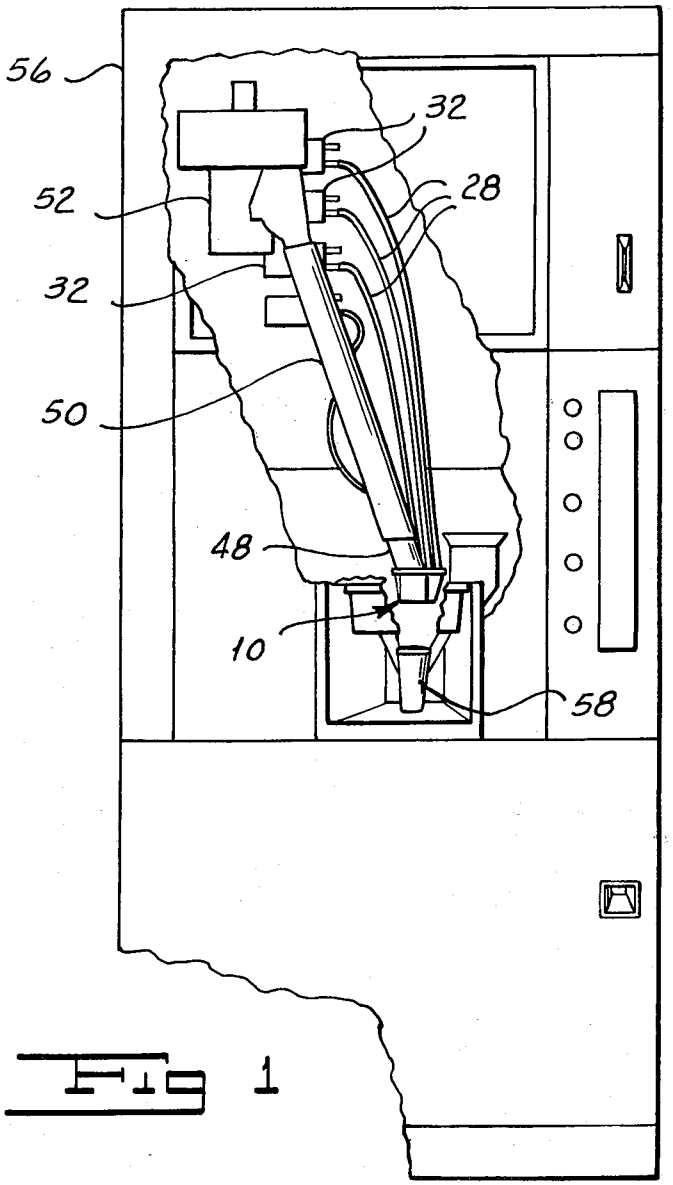
FIG. 1 is a front elevation of a cold drink machine with parts broken away provided with my nozzle assembly.

Referring now to FIG. 1 of the drawings, a cold drink merchandiser 56 with which my nozzle assembly, indicated generally by the reference character 10, is adapted to be used, is provided with a cup delivery mechanism (not shown) of any suitable type known to the art for delivering a cup 58 to a location accessible to the customer at which the drink is dispensed. The machine 56 includes a plurality of respective syrup pumps 32 adapted to be actuated in a manner known to the art to deliver charges of syrup through lines 28 to the assembly 10. An ice maker 52 is adapted to be actuated to deliver a charge of ice through a tube 50 to a chute 48 supported on the assembly 10 in a manner to be described more fully hereinbelow. Further, as will be described, the assembly 10 is adapted to receive a charge of still or carbonated water from sources (not shown) in the course of a cycle of operation of machine 56.

Figure 4:
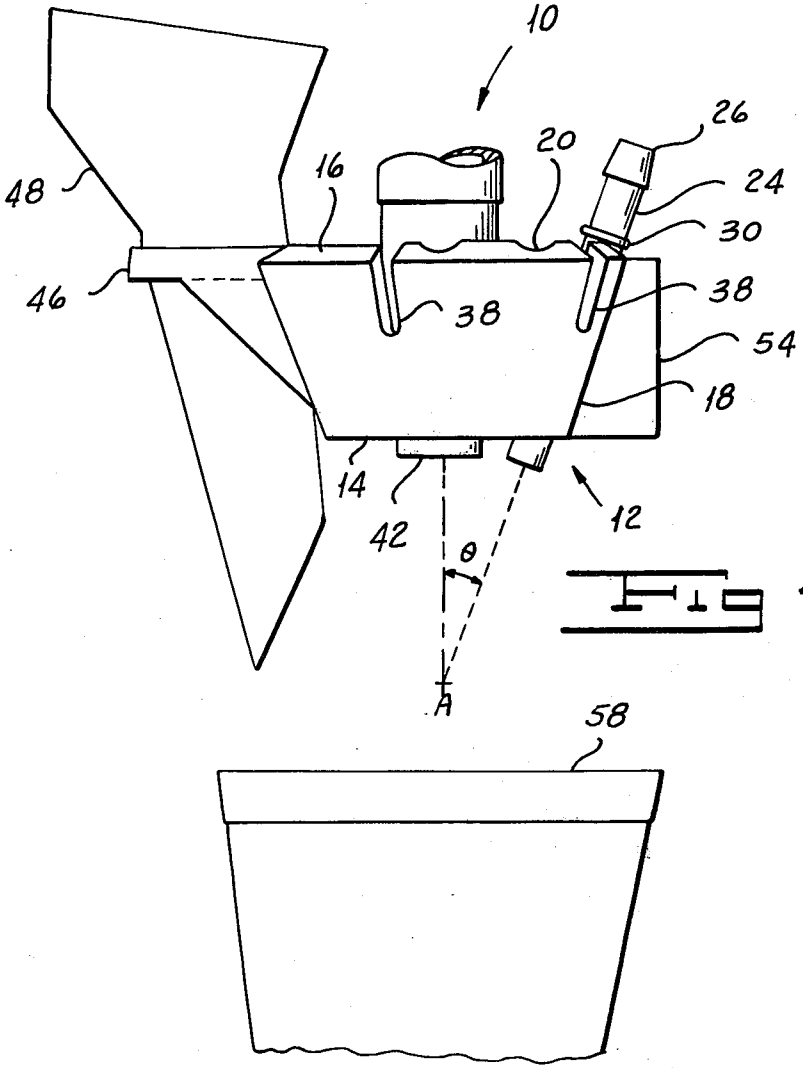
FIG. 4 is an elevation of my nozzle assembly for a cold drink merchandiser taken along the lines 4—4 of FIG. 2, with parts removed and showings its relationship to a cup to which a drink is to be delivered.
Figure 2:
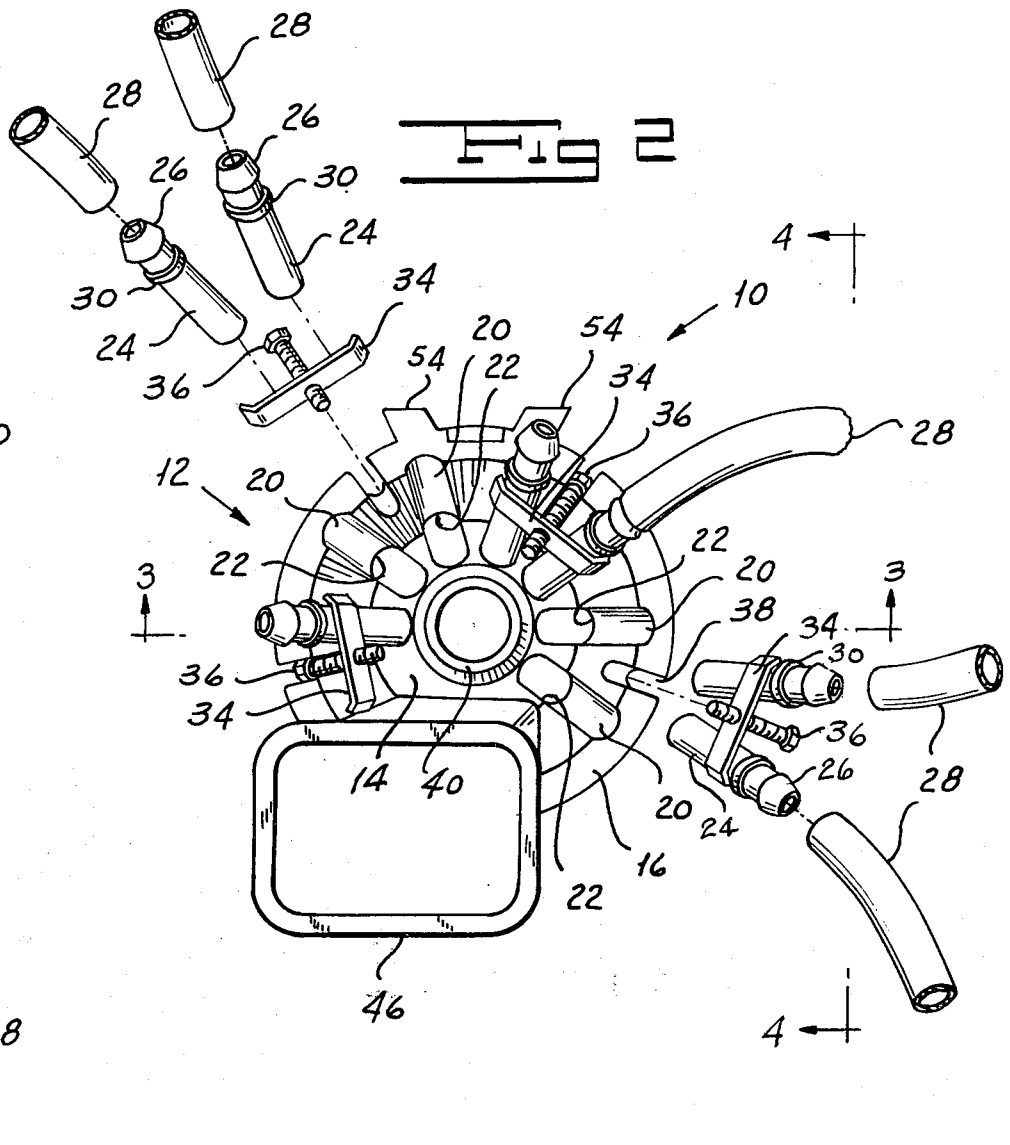
FIG. 2 is a partially exploded plan view of my nozzle assembly for a cold drink merchandiser.
Figure 3:
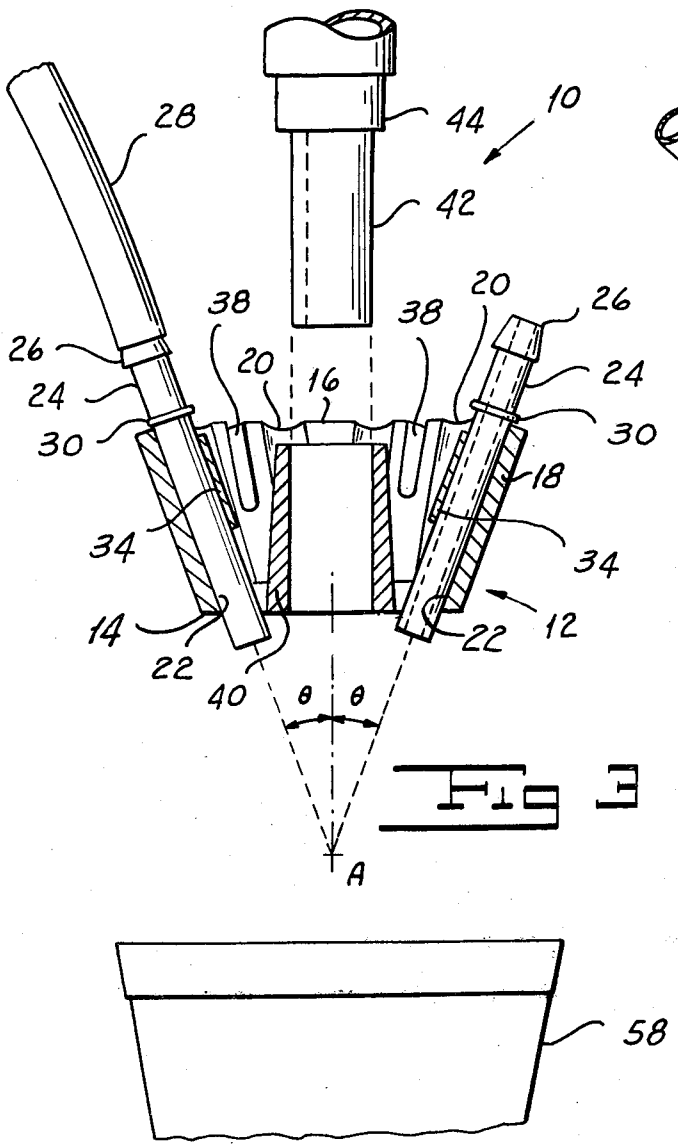
FIG. 3 is a partially exploded sectional view of my nozzle assembly for a cold drink merchandiser taken along the lines 3—3 of FIG. 2, showing its relationship to a cup to which a drink is to be delivered.

Referring now to FIGS. 2 to 4 of the drawings, my nozzle assembly indicated generally by the reference character 10, includes a hollow inverted frustro-conical body 12, indicated generally by the reference character 12, having a base 14, a sidewall 18 and a rim 16. I form the inner surface of the wall 18 with a plurality of grooves 20 of generally hemicylindrical cross section extending from rim 16 along the sidewall 18 to a respective oval shaped opening 22 in the base 14. Each groove 20 receives a cylindrical nozzle 24 having a truncated conical head 26 for receiving one end of a hose 28, and a collar or flange 30 which limits the movement of the nozzle along the groove to a position at which a predetermined part of the lower end extends through the corresponding respective oval shaped opening 22 in the base 14. It will readily be appreciated that the inner diameter of the nozzle used is determined by the viscosity of the syrup with which it is associated. That is, nozzles having a larger internal diameter may be used for heavier syrups.

The nozzles 24 are releaseably held in their respective recesses 20 by generally rectangular metal clamps 34, each having an internally threaded opening to receive a screw 36. Screws 36 extend through slots 38 formed in sidewall 18, with the heads of the screws bearing against the outer surface of the sidewall. By loosening the screws 36, the nozzles 24 can be easily removed from and re-inserted into respective grooves 20 for cleaning or replacement.

I form the body 12 with a centrally located hollow generally cylindrical guide 40 having an internal bore extending through the base 14. The bore of the guide 40 is adapted to receive the lower cylindrical end of a water supply pipe 42 formed with a shoulder 44 adapted to engage the upper end of guide 40 when the pipe is in position. I connect the upper end of pipe 42 to a line which is supplied with the principal constituent of the beverage in a manner known to the art.

As is known in the art, in operation of the drink machine 56, when a selection is made, the pipe 42 will direct a stream of either carbonated or still water into a cup 58. In accordance with the flavor selected, one of the syrup pumps 32 will pump a measured quantity of syrup through the respective tube 28 to the respective nozzle 24. The nozzle 24 will direct a stream of the syrup towards the water stream.

I so form the nozzle assembly 10 that the syrup stream from each nozzle 24 is directed towards the water stream at the same angle $\theta$. In addition, as the end of each nozzle 24 is located the same fixed distance from the end of the pipe 42, as determined by flange 30, the point of intersection of each syrup stream with the water stream is at the same point A.

It is desirable to position the nozzle holder 10 in the drink machine 56 so that the point of intersection of the water stream with any syrup stream is above the cup 58, thus assuring an adequate mixture of syrup and water. To this end, the body 12 carries bosses 54, which are received in a suitable bracket (not shown) located within the drink machine 56. The bosses 54 and bracket support and accurately position the nozzle holder 10 within the drink machine 56, so that the point A is above the cup 58.

I form my nozzle holder 10 with a rectangular frame 46 for supporting an ice chute 48, which may be connected by a pipe 50 to the reservoir of icemaker 52. When activated, the machine 52 drops a measured quantity of crushed ice into the pipe 50, the chute 48 directs the ice into the cup 58.

I form the body 12 and the nozzles 24 from any suitable plastic material, such for example as Lexan, which is the registered trademark of General Electric Company for a thermoplastic polycarbonate resin.

It will be seen that I have accomplished the objects of my invention. I have provided a nozzle holder which accurately positions each nozzle for intersection of its syrup stream with a common water stream at a prescribed angle and location. My nozzle holder permits the easy removal and replacement of nozzles and supports an ice chute. My nozzle holder is formed from easily molded parts and is readily disassembled for cleaning. It is relatively simple and inexpensive for the result achieved thereby.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a drink machine for selectively delivering one of a plurality of beverages each having a principal constituent and a selected flavoring constituent to a cup positioned at a delivery location at which the cup is accessible to a customer, apparatus including a unitary body formed with a base and a centrally located guide extending upwardly from said base, said guide formed with a bore having a longitudinal axis extending generally perpendicular to said base, said base having a plurality of holes therethrough outside said guide and circumferentially spaced around said axis, said body being formed with a wall extending upwardly from said base in the region of said holes to an upper rim, the inner surface of said wall inclined outwardly from said base toward said rim, a plurality of grooves in said inner surface extending from said rim respectively into said holes, a plurality of elongated syrup nozzles, each of said nozzles having a central passage with a longitudinal axis, an external surface with a generally circular cross-sectional shape and a positioning shoulder formed along the length thereof, each of said grooves having a generally semicircular cross-sectional shape whereby each of said grooves is adapted to receive one of said nozzles with the shoulder thereof in engagement with said rim to position said nozzle along the length of said groove, a plurality of retainers, means for releaseably securing said retainers to said body with the retainers in engagement with parts of said nozzles outside said grooves to retain said nozzles in said grooves, a beverage principal constituent supply fitting having a passage with a longitudinal axis and a shoulder and adapted to be received in said guide with the guide axis generally coincidental with the fitting axis and with said shoulder in engagement with the upper end of said guide, said body being formed with an ice chute support and means mounting said body in said machine at a position adjacent to said delivery location with said nozzle axes intersecting said fitting axis at a predetermined point above a cup at said delivery location.

2. In a drink machine for selectively delivering one of a plurality of beverages, each having a principal constituent and a selected flavoring constituent to a cup positioned at a delivery location at which the cup is accessible to a customer, apparatus including a unitary body formed with a base and a centrally located guide extending upwardly from said base, said guide formed with a bore having a longitudinal axis extending generally perpendicular to said base, said base having a plurality of holes therethrough outside said guide and circumferentially spaced around said axis, said body being formed with a wall extending upwardly from said base in the region of said holes to an upper rim, the inner surface of said wall inclined outwardly from said base toward said rim, a plurality of grooves in said inner surface extending from said rim respectively into said holes, a plurality of elongated syrup nozzles, each of said nozzles having a central passage with a longitudinal axis, an external surface with a generally circular cross-sectional shape and a positioning shoulder formed along the length thereof, each of said grooves having a generally semicircular cross-sectional shape whereby each of said grooves is adapted to receive one of said nozzles with the shoulder thereof in engagement with said rim to position said nozzle along the length of said groove, means for releaseably securing said nozzles in said grooves, a beverage principal constituent supply fitting having a passage with a longitudinal axis and a shoulder and adapted to be received in said guide with the guide axis generally coincident with the fitting axis and with said shoulder in engagement with the upper end of said guide, and means mounting said body in said machine at a position adjacent to said delivery location with said nozzle axes intersecting said fitting axis at a predetermined angle and at a predetermined point above a cup at said delivery location.

3. In a drink machine for selectively delivering one of a plurality of beverages each having a principal constituent and a selected flavoring constituent to a cup positioned at a delivery location at which the cup is accessible to a customer, apparatus including a unitary body formed with a base and a centrally located guide extending upwardly from said base, said guide formed with a bore having a longitudinal axis extending generally perpendicular to said base, said base having a plurality of holes therethrough outside said guide and circumferentially spaced around said axis, said body being formed with a wall extending upwardly from said base in the region of said holes to an upper rim, the inner surface of said wall inclined outwardly from said base toward said rim, a plurality of grooves in said inner surface extending from said rim respectively into said holes, a plurality of elongated syrup nozzles, each of said nozzles having a central passage with a longitudinal axis, an external surface with a generally circular cross-sectional shape and a positioning shoulder formed along the length thereof, each of said grooves having a generally semicircular cross-sectional shape whereby each of said grooves is adapted to receive one of said nozzles with the shoulder thereof in engagement with said rim to position said nozzle along the length of said groove, means for releasably securing said nozzles in said grooves, and means mounting said body in said machine at a position adjacent to said delivery location with said nozzle axes intersecting said guide axis at a predetermined angle and at a predetermined point above a cup at said delivery location.

4. In a drink machine for selectively delivering one of a plurality of beverages each having a principal constituent and a selected flavoring constituent to a cup positioned at a delivery location at which the cup is accessible to a customer, apparatus including a unitary body formed with a base and a centrally located guide extending upwardly from said base, said guide formed with a bore having a longitudinal axis extending generally perpendicular to said base, said base having a plurality of holes therethrough outside said guide and circumferentially spaced around said axis, said body being formed with a wall extending upwardly from said base in the region of said holes to an upper rim, the inner surface of said wall inclined inwardly from said rim toward said base, a plurality of grooves in said inner surface extending from said rim respectively into said holes, a plurality of elongated syrup nozzles, each of said nozzles having a central passage with a longitudinal axis and an external surface with a generally circular cross-sectional shape, each of said grooves having a generally semicircular cross-sectional shape whereby each of said grooves is adapted to receive one of said nozzles, means for releasably securing said nozzles in said grooves, and means mounting said body in said machine at a position adjacent to said delivery location with said nozzle axes intersecting said guide axis at a predetermined angle and at a predetermined point above a cup at said delivery location.

5. In a drink machine for selectively delivering one of a plurality of beverages, each having a principal constituent and a selected flavoring constituent to a cup positioned at a delivery location at which the cup is accessible to a customer, apparatus including a unitary body formed with a base having a plurality of circumferentially spaced holes therethrough, said body being formed with a wall extending upwardly from said base in the region of said holes to an upper rim, the inner surface of said wall inclined inwardly from said rim toward said base, a plurality of grooves in said inner surface extending from said rim respectively into said holes, a plurality of elongated syrup nozzles, each of said nozzles having a central passage with a longitudinal axis and an external surface with a generally circular cross-sectional shape, each of said grooves having a generally semi-circular cross-sectional shape whereby each of said grooves is adapted to receive one of said nozzles, means for releasably securing said nozzles in said grooves, and means mounting said body in said machine at a position adjacent to said delivery location with said nozzle axes intersecting at a predetermined angle and at a predetermined point above a cup at said delivery location.

6. In a drink machine for selectively delivering one of a plurality of beverages each having a principal constituent and a selected flavoring constituent to a cup positioned at a delivery location at which the cup is accessible to a customer, apparatus including a unitary body formed with a base, said base having a plurality of circumferentially spaced holes therein and said body being formed with a wall extending upwardly from said base in the region of said holes to an upper rim, the inner surface of said wall inclined inwardly from said rim toward said base, a plurality of grooves in said inner surface extending from said rim respectively into said holes, a plurality of elongated syrup nozzles, each of said nozzles having a central passage with a longitudinal axis, an external surface with a certain cross-sectional shape, each of said grooves having a cross-sectional shape corresponding to a part of the cross-sectional shape of said nozzles whereby each of said grooves is adapted to receive one of said nozzles, means for releasably securing said nozzles in said grooves, and means mounting said body in said machine at a position adjacent to said delivery location with said nozzle axes intersecting at a predetermined angle and at a predetermined point above a cup at said delivery station.

7. In a drink machine for dispensing a beverage having a principal constituent and a flavoring constituent in a cup positioned at a delivery location at which the cup is accessible to a customer, apparatus including a beverage principal component delivery tube having a longitudinal axis, means positioning said tube in said machine adjacent to said delivery location with the axis thereof extending toward the inside of a cup at said location to deliver said principal constituent to said cup, an elongated flavoring constituent nozzle having a central passage with a longitudinal axis and having an exterior cross-sectional shape of a predetermined configuration, said nozzle having a locating shoulder on the outer surface thereof, a nozzle support member, means mounting said support member in said machine adjacent said delivery location, an elongated passage in said support member, said passage having a cross-sectional shape conforming to a portion of that of said nozzle, said passage having a longitudinal axis which intersects said tube axis, said passage adapted to receive said nozzle, said shoulder adapted to engage said support at one end of said passage to locate said nozzle on said support, and means for releasably retaining said nozzle in said passage.

8. In a drink machine for dispensing a beverage having a principal constituent and a flavoring constituent in a cup positioned at a delivery location at which the cup is accessible to a customer, apparatus including an elongated flavoring constituent nozzle having a central passage with a longitudinal axis and having an exterior cross-sectional shape of a predetermined configuration, said nozzle having a locating shoulder on the outer surface thereof, a nozzle support member, means mounting said support member in said machine adjacent said delivery location, an elongated passage in said support member, said passage having a cross-sectional shape conforming to a portion of that of said nozzle, said passage adapted to receive said nozzle, said shoulder adapted to engage said support at one end of said passage to locate said nozzle on said support, and means for releasably retaining said nozzle in said passage.

9. In a drink machine for selectively delivering one of a plurality of beverages, each having a principal constituent and a selected flavoring constituent to a cup which is positioned at a delivery location at which the cup is accessible to a customer, an integrally molded principal constituent supply fitting and syrup constituent supply nozzle support body comprising a base, a centrally located guide extending upwardly from said base, said guide formed with a bore having a longitudinal axis extending generally perpendicular to said base, said base having a plurality of holes therein outside said guide and circumferentially spaced around said axis, said body being formed with a wall extending upwardly from said base in the region of said holes to an upper rim, the inner surface of said wall tapering inwardly from said rim toward said base and a plurality of grooves in said inner surface extending from said rim respectively into said openings, said grooves having longitudinal axes which intersect said guide axis at a predetermined point.

10. In a drink machine for selectively delivering one of a plurality of beverages each having a principal constituent and a selected flavoring constituent to a cup which is positioned at a delivery location at which the cup is accessible to a customer, an integrally molded support body comprising a base, a centrally located opening having an axis generally perpendicular to said base, said base having a plurality of openings therein outside said guide and circumferentially spaced around said axis, said body being formed with a wall extending upwardly from said base in the region of said holes to an upper rim, the inner surface of said wall tapering inwardly from said rim toward said base and a plurality of grooves in said inner surface extending from said rim respectively into said openings, said grooves having longitudinal axes which intersect said opening axis at a predetermined point.

11. In a drink machine for selectively delivering one of a plurality of beverages each having a principal constituent and a selected flavoring constituent to a cup which is positioned at a delivery location at which the cup is accessible to a customer, a support body comprising a base having a plurality of spaced openings therein, said body being formed with a wall extending upwardly from said base in the region of said holes to an upper rim, the inner surface of said wall tapering inwardly from said rim toward said base and a plurality of grooves in said inner surface extending from said rim respectively into said openings, said grooves having longitudinal axes which intersect at a predetermined point with relation to a cup positioned at said delivery location.

* * * * *